United States Patent [19]

Morton

[11] 4,019,729

[45] * Apr. 26, 1977

[54] APPARATUS FOR CONTROLLABLY LOWERING AND LIFTING A PLY PICKING UNIT

[75] Inventor: Kenneth O. Morton, Troy, N.Y.

[73] Assignee: Cluett, Peabody & Co., Inc., New York, N.Y.

[ * ] Notice: The portion of the term of this patent subsequent to Feb. 24, 1993, has been disclaimed.

[22] Filed: Nov. 12, 1975

[21] Appl. No.: 631,077

Related U.S. Application Data

[62] Division of Ser. No. 471,029, May 17, 1974, Pat. No. 3,940,125.

[52] U.S. Cl. ..... 271/18.3; 271/10

[51] Int. Cl.[2] ..... B65H 3/22

[58] Field of Search ..... 271/19–25, 271/18.3, 16, 17, 10, 33, 107, 1, 14, 118, 11; 214/8.5 C

[56] References Cited

UNITED STATES PATENTS

| | | | |
|---|---|---|---|
| 747,865 | 12/1903 | Dexter et al. | 271/19 |
| 3,353,821 | 11/1967 | Smith et al. | 271/22 X |
| 3,442,505 | 5/1969 | Szentkuti | 271/21 X |
| 3,588,091 | 6/1971 | Stone et al. | 271/19 |

*Primary Examiner*—Evon C. Blunk
*Assistant Examiner*—Bruce H. Stoner, Jr.

[57] ABSTRACT

The disclosure relates to a novel apparatus for lowering and lifting a ply picking unit into controlled pressure contact with the top ply of a stack of limp plies. The picking unit is supported by a lifting lever, which is pivotally mounted on a frame. An actuator, operable through a predetermined stroke, is interconnected with the lifting lever by a slideable connector, with an adjustable spring acting between the actuator and the slideable connector. The apparatus of the invention further includes means independent of the actuator for effectively, substantially balancing the lifting lever. The novel combination of a balanced lifting lever, actuator, slideable connector and adjustable spring results in an improved lever action, for lowering and lifting the ply picking unit, that is positive in operation and accurately adjustable to meet the particular requirements of an overall apparatus to nip and lift limp plies from a stack thereof.

10 Claims, 6 Drawing Figures

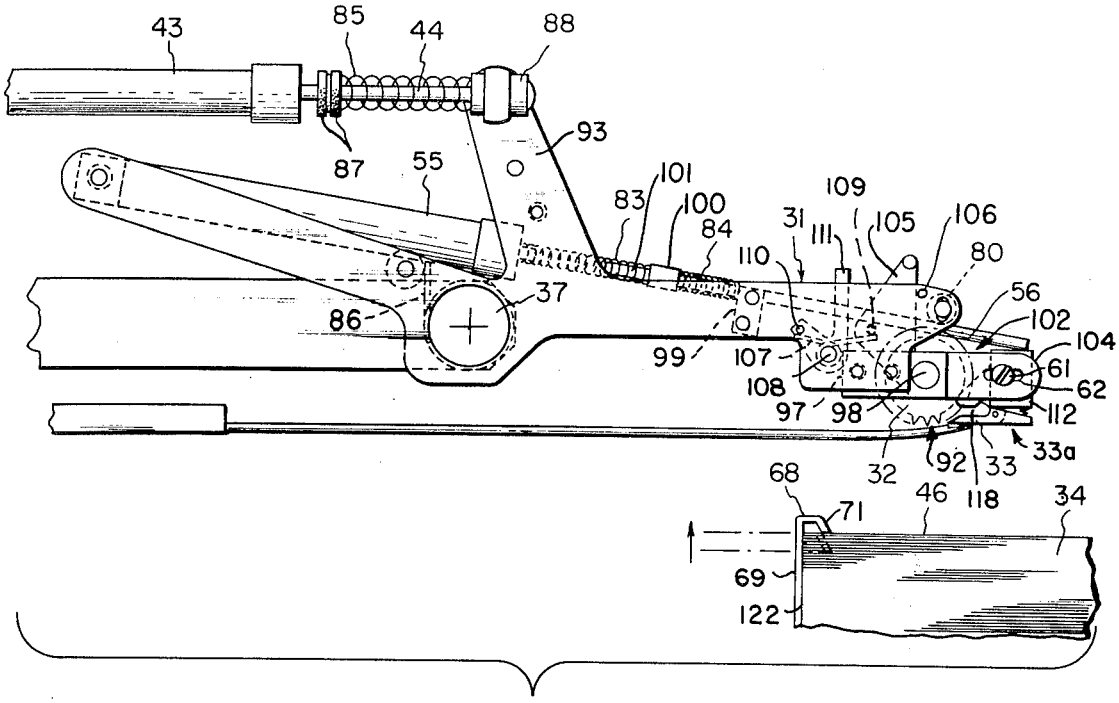
FIG. 3
FIG. 5
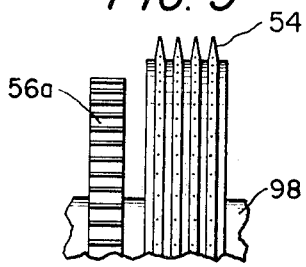
FIG. 4
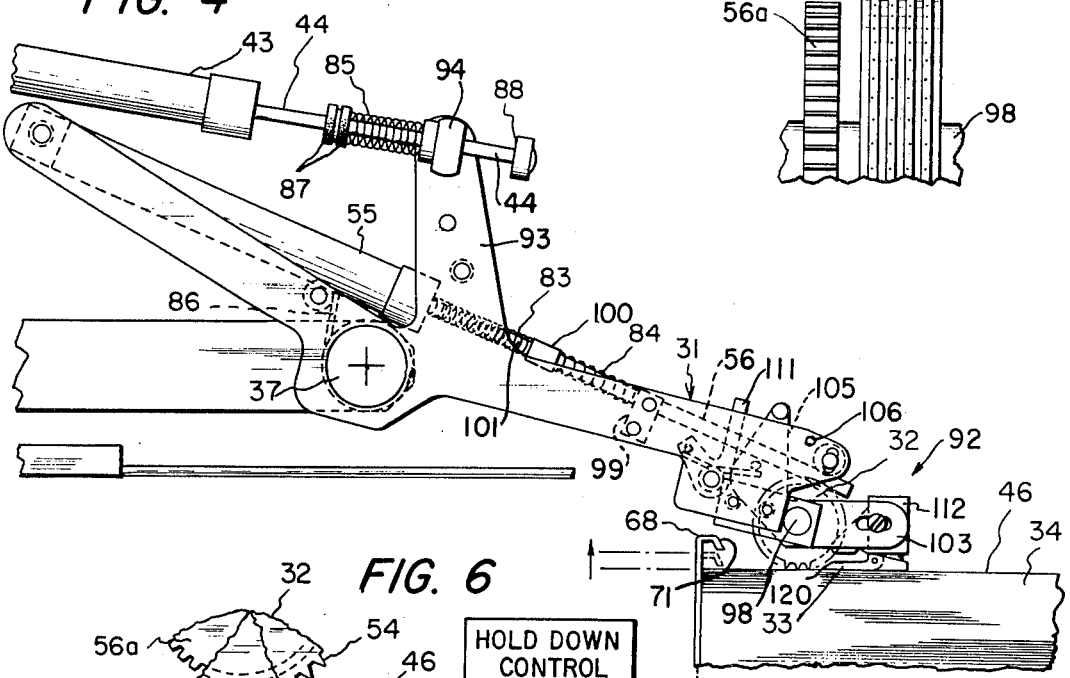
FIG. 6
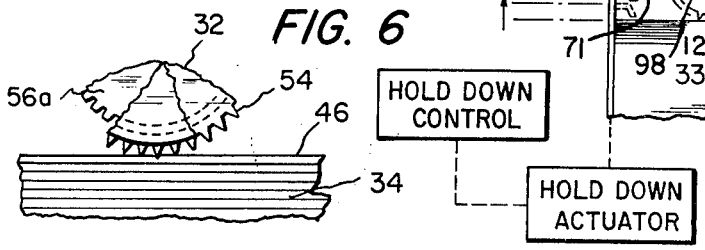

APPARATUS FOR CONTROLLABLY LOWERING AND LIFTING A PLY PICKING UNIT

This is a division of application Ser. No. 471,029, filed May 17, 1974, now U.S. Pat. No. 3,940,125.

BACKGROUND AND SUMMARY OF INVENTION

The present invention is directed to a novel and improved means for engaging and removing a ply of limp material, typically a piece of fabric, from a stack of such plies. In the production of garments, for example, it is conventional practice to cut simultaneously an entire stack of garment sections from a stacked lay-up of fabric sections. The cut stack of fabric sections is then transferred to a subsequent production operation, in which the sections are removed one at a time for sewing, etc.

In a continuing effort to automate production operations of all kinds, substantial effort has been devoted to the development of systems capable of lifting off and separing the uppermost ply of fabric from a stack of pre-cut fabric sections and transporting the separated ply to a desired location for performance of a production operation. Prior proposals for this purpose have involved the use of means such as suction devices or pressure sensitive tapes, for example, for lifting off the top ply of a stack. Other arrangements heretofore proposed have involved the use of needle-like elements for engaging and lifting off the uppermost ply of a stack. A still further proposal for this purpose is represented by the Lutts et. al. U.S. Pat. No. 3,756,587.

Many of the above mentioned prior proposed arrangements are effective at a certain level, but each has disadvantages of one kind or another which limits its usefulness. For example, in an operation in which all conditions are fixed, with a single size and shape of ply and with the ply being at all times of the same material, it is frequently possible to adjust and adapt one or more of the various prior art devices for operation at a reasonable level of efficiency. However, in a more typical operation, the equipment may be called upon to handle parts of a variety of sizes and/or shapes and also to handle parts of different materials for which the prior art devices are not well suited. Even where a production operation involves only a single size and shape of part, serious problems may be experienced in dealing with a plurality of materials on different occasions. All of the prior art systems, insofar as the applicant is aware, have significant shortcomings in an environment requiring the handling of a variety of materials and/or shapes.

It is an object of the present invention to provide, in an apparatus for nipping and lifting a limp ply from a stack, a lifting unit for lowering and lifting a ply picking unit, whereby the pressure applied by the ply picking unit to the top ply of the ply stack may be accurately controlled. In its broadest aspect, the present invention consists of an apparatus for nipping and lifting a limp ply, supported by a lifting unit for controllably lowering and lifting the ply picking unit. The ply picking unit is supported at one end of a lifting lever, which is pivotally mounted on a supporting frame structure. An actuator, operable through a predetermined stroke, is also pivotally mounted on the frame stucture and interconnected with the lifting lever by a slideable connecting means. The lifting lever is substantially balanced by a balancing means which acts independently of the actuator. Moreover, an adjustable, yieldable means is associated with the actuator means and slideable connecting means, whereby the force imparted by the actuator means to the lifting lever may be accurately controlled.

The unique combination of a substantially balanced lifting lever, operated by an adjustable actuating force permits a lever action for lowering and lifting a ply picking unit that is positive in operation and accurately adjustable to control the pressure contact between the ply picking unit and the top ply. It is to be understood that different ply materials may have widely different characteristics of stiffness, thickness, weight, roughness or smoothness, susceptibility to damage or marking, etc. The apparatus of the invention uniquely accommodates such variable conditions by permitting the adjustment and accurate control of the pressue applied by the ply picking unit to the ply of a ply stack. While not critical to the present invention, the apparatus described herein is ideally suited for use in combination with the picking apparatus for nipping and lifting a limp ply which is described and claimed in copending application of Kenneth O. Mortion, Ser. No. 471,029, filed May 17, 1974, now U.S. Pat. No. 3,940,125, which is hereby incorporated by reference.

For a better understanding and appreciation of the above and other features and advantages of the invention, reference should be made to the following detailed description of a preferred embodiment and to the accompanying drawings. It should especially be understood that many of the features of the invention may be used to advantage individually as well as in association with some or all of the other features.

DESCRIPTION OF THE DRAWINGS

FIGS. 3 and 4 are enlarged, fragmentary view of a ply nipping and lifting mechansim incorporated in the system of FIG. 1, illustrating a sequence of positions of such mechanism.

FIGS. 5 and 6 are enlarged, fragmentary front and side views of a ply gripping wheel utilized in the mechanism of FIGS. 3 and 4.

DESCRIPTION OF A PREFERRED EMBODIMENT OF THE INVENTION

Figure 1:
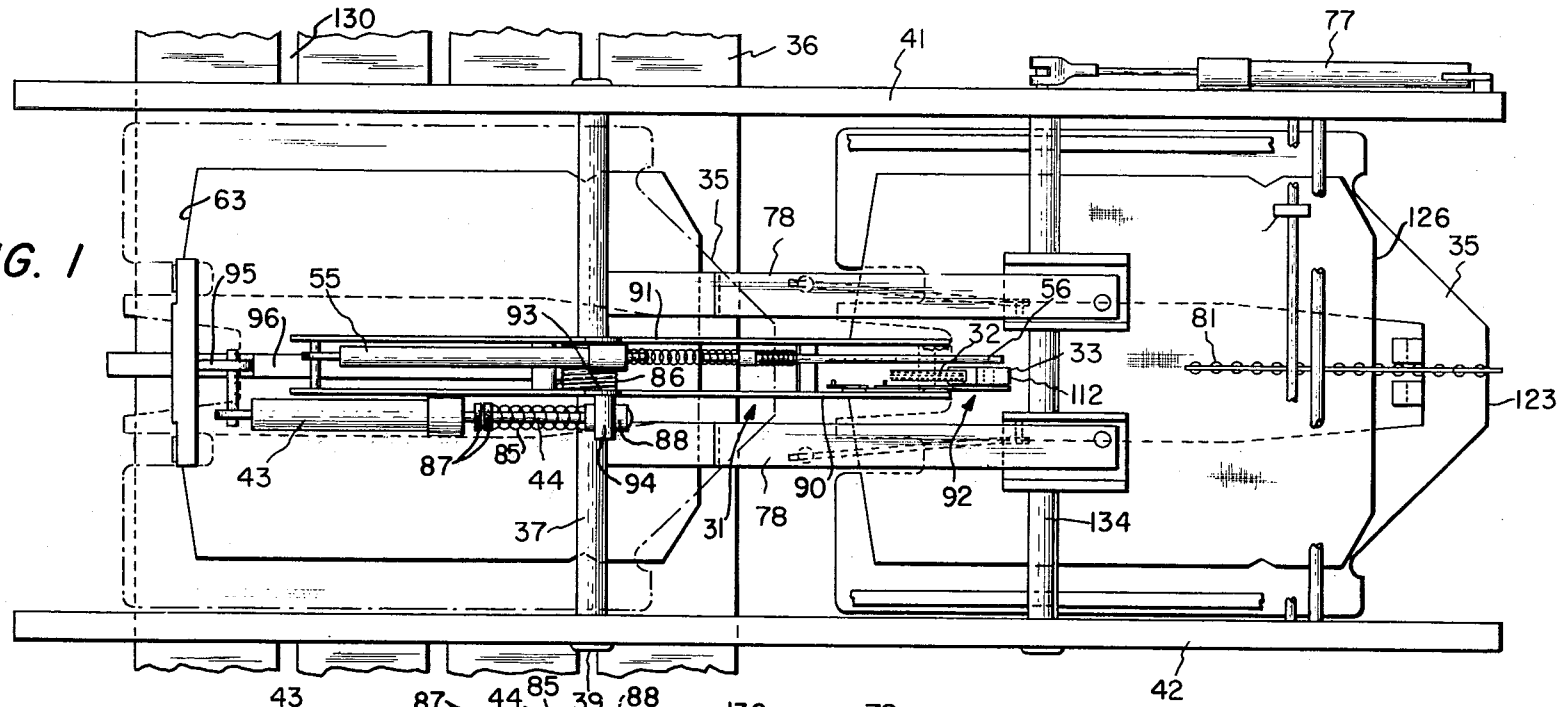
FIG. 1 is a top plan view of a ply separating and transporting system incorporating the features of the invention, as utilized, for example, in the handling of fabric sections in the manufacture of wearing apparel.
Figure 2:
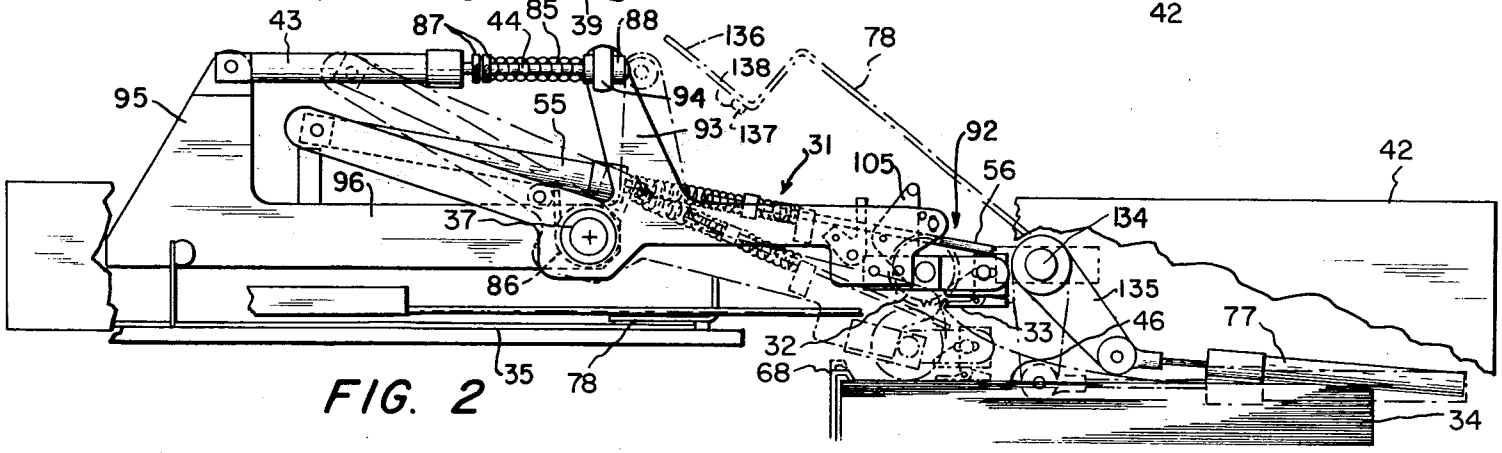
FIG. 2 is a side elevational view of the system of FIG. 1.

Referring now to the drawings, and initially to FIGS. 1 and 2 thereof, there is shown a ply lifting and transporting means as typically used in the performance of a subassembly operation in the manufacture of wearing apparel. A stack 34 of individual fabric sections (shirt pocket sections in the illustration) is supported along side a conveyor belt 36 leading to a sewing machine or other processing apparatus (not shown). The mechanism of the invention serves to nip, separate and lift plies of fabric, one at a time, from the stack 34, and to transport them to the conveyor belt 36. After proper positioning and reorienting of the fabric section, it is deposited on the belt 36 for conveyance to the processing apparatus.

In its illustrated form, the apparatus includes a pair of frame members 41, 42 which support the working parts of the apparatus in desired relation to the ply stack and to the conveyor 36. A shaft 37 extends between the frame members and forms a pivot support for the lifting arm assembly, generally designated by the numeral 31, which comprises a pair of arm plates 90, 91, journalled on the shaft 37 and connected together in spaced relation. At its outer end, the lifting arm 31 supports a ply picking unit, generally designated by the numeral 92.

As reflected in FIGS. 1 and 2, the lifting arm assembly 31 includes an upwardly extending lever arm 93. This arm is connected by a pin 94 to the piston rod 44 of a pneumatic actuator 43, sometimes referred to as the lifting actuator. The body of the lifting actuator is in turn connected to an upward extension 95 of a central frame plate 96, mounted with fixed relation to the outer frame plates 41, 42. In accordance with the invention, the actuator rod 44 is not directly connected to the pin 94, but is slidably associated therewith, with the pin 94 being urged against the head 88 of the actuator rod by means of a light, compression spring 85. The initial compression in the spring 85 is determined by means of threaded collars 87 adjustably positioned on the actuator rod. The arrangment is such that, when the actuator 43 is operated through a full stroke in the extending direction, the maximum torque imparted to the lifting arm assembly thereby will be accurately limited by the adjusted setting of the spring 85. The latter merely compresses when the arm assembly meets a predetermined resistance, permitting the rod 44 to slide through the connecting pin 94 (see FIG. 4). Desirably, the spring 85 has a relatively small spring constant, such that some degree of variabiliy in the overtravel of the actuator rod may be accommodated without significantly affecting the compression force applied by the spring 85.

In the illustrated embodiment, the lifting arm assembly 31 is also acted upon by a torsion spring 86, which is adjusted as necessary to substantially offset any weight unbalance in the overall arm assembly. If desired this could also be accomplished by means of a suitably positioned counterweight. In either case, the objective is to closely balance the assembly, so that the operating pressures exerted by the arm may be very delicately and precisely controlled by the compression spring 85.

Mounted on the end of the lifing arm assembly 31 is a picking unit 92 which, when the lifting arm is lowered by extension of the actuator 43, is arranged to be brought into engagement with the uppermost ply 46 of the ply stack 34, for engagement with the upper ply in a manner to be described. To particular advantage, the picking unit is built in accordance with the disclosure of the aforementioned Morton patent. The picking unit includes a pair of bearing plates 97 secured to the outer ends of the lifting arms 90, 91 and rotatably supporting a wheel shaft 98. Keyed or otherwise secured to the wheel shaft 98 is a ply gripping wheel assembly 32 and a drive pinion **56*a* therefor. The pinion 56*a* cooperates with a rack element 56, which is guided for longitudinal movement in meshing relation with the pinion 56*a* by means of a back-up roller 80** carried by the lifting arms.

At its inner end, the rack element 56 is guide by a bearing block 99 and is connected by a coupler 100 to the operating rod 101 of an air actuator 55. The actuating rod 101 is normally urged to an initial static position intermediate it fully extended or fully retracted positions, by means of compression springs 83, 84 received over the actuating rod 101 and rack 56 respectively. The spring 83 acts between the end of the actuator and the coupler 100, while the spring 84 acts between the coupler 100 and the bearing block 99. The initial compression of the springs 83, 84 is such that the opposed compression forces are balanced when the actuator rod 101 is in an intermediate position, typically somewhat toward the extended position from the midpoint of its full stroke.

When the actuator 55, which may be referred to as the nipping actuator, is operated to retract the rod 101, the pinion **56*a* and associate wheel assembly 32** are rotated in a couterclockwise direction, as viewed in the drawings to displace the top ply against a retaining means as will be described below.

Pivotally supported by the wheel shaft 98 is a pressing unit generally designated by the reference numeral 102. The pressing unit includes a supporting lever 103, mounted on the wheel shaft and provided with an outwardly extending arm 104 and an upwardly extending arm 105. The arm 105 is normally urged into contact with an abutment stop 106, by means of a spring 107 carried by a shaft 108 and acting at its opposite ends on a pin 109 carried by the lever arm 105 and a pin 110 carried by a pressure adjustment lever 111. The pressure adjustment lever 111 is pivotally mounted on the shaft 108 and is frictionally or otherwise retained in a pre-set position. Counterclockwise pivoting of the adjusting lever 111 will result in the application of increased upward pressure by the spring 107, increasing the clockwise bias of the lever 103. Typically, the spring 107 is very light, affording a delicate bias adjustment of pivoting movements of the lever 103 about the wheel shaft 98.

Secured to the lever arm 104, typically by means of a mounting screw 61 received in an adjusting slot 62, is a pressing foot **33*a*. In the illustrated construction, the pressing foot 33*a* includes a body section 112, to which is secured a pair of spaced ply stripping plates 113**.

Pivotally secured to the block 112, is a pressing foot 33 which is adapted to press upon the ply stack 34, when the lifting arm assembly 31 is lowered by extension of the lifting actuator 43.

In accordance with the invention, nipping of a single uppermost ply 46 from the stack 34, is accomplished by first energizing the actuator 43 to extend its operating rod 44 and pivot the lifting arm assembly 31 in a clockwise direction. When the picking unit 92 engages the top of the ply stack, a reaction or resistance force is imparted to the lifting arm 31, resisting further clockwise movement. The operating rod 44 nevertheless is extracted through its full stroke, while the spring 85 compresses to accommodate continued movement of the rod without effecting further movement of the lifting arm. The effective force applied by the compression spring 85 is adjusted in accordance with empirical observations, to accommodate various materials, depending upon such factors as ply thickness, density, resilience, etc. When the compression of the spring 85 is properly adjusted, a full extension of the operating rod 44 will apply a delicately controlled pressure (e.g. a few ounces) to the ply stack 34, such that the gripping wheel assembly 32 will penetrate a single ply sufficiently to effectively grip that ply, but will not penetrate to the depth of the second ply. In some instances, it may be desired to pick exactly two plies off of the stack, which can be accomplished with the present apparatus by proper adjustment of its components including if needed, the use of a larger effective tooth depth on the wheel 32.

A typical ply nipping and lifting sequence is as follows. Initially, the entire lifting arm assembly 31 is lowered by energizing the lift actuator 43, bringing the gripping wheel 32 into precisely controlled pressure contact with the upper ply, as determined by the spring 85, and likewise bringing the pressing shoe 33 into precisely controlled contact with the ply, under pressure determined by the seating of the spring 107. The geometrical relationship of the ply stack 34 and the lifting arm assembly is such that the wheel 32 and pressing foot assembly 33a engage the ply stack adjacent but spaced inwardly a short distance from the edge 122 of the ply stack (which, for purpose of description, may be considered as the forward edge).

After the arm assembly has descended onto the stack, the nipping actuator 55 is energized to retract its operating rod 101 and effect counterclockwise rotation of the gripping wheel 32. As will be apreciated, the teeth 54 of the gripping wheel, engaging the uppermost ply 46, drive the ply toward the right substantially in its plane. However, since the ply is held fixed by the pressing shoe 33, only the edge portion of the ply, to the left of the shoe, is permitted to move. As a result, the flexible ply material, in the short area between the bottom of the wheel 32 and the forward edge 120 of the nipping shoe, is buckled upwardly, and carried upward and to the right by the rotation of the wheel. After the first few degrees of rotation, the folded over leading edge of the upwardly buckled wave of the ply comes into contact with the stripping surfaces 114. With continued rotation of the wheel, the ply is progressively diverted outward from and stripped off of the wheel teeth by the stripping surfaces, and a loop or fold of the ply material accumulates in the slot 118 above the pressing shoe. It will be appreciated, in this respect, that the material for the accumulating loop is drawn entirely from the left side of the pressing shoe 33, with the material under the shoe and to the right of it being held stationary by the pressure of the shoe. When a unit is lifted, the pressing shoe pivots back toward its initial position, to enhance the gripping action.

A hold down element 68, movably carried by a support 69, is actuated by completion of the retracting stroke of the actuator 55 and caused to descend (by gravity or other means) upon the ply stack, to the position shown in FIG. 2. To advantage, the hold down element 68 includes a downwardly extending finger 71, which engages the top of the ply stack at a point spaced inward from the forward edge 122 of the stack a distance slightly less than the distance through which the uppermost ply 46 is displaced during the nipping movement of the wheel 32. Thus, when the hold down element 68 descends, the finger 71 presses down upon and restrains the folded over edge of the next ply or plies.

After picking the unit 92 has been retracted to its raised position, carrying with it the detached forward edge of the ply 46, a transport shutter 35 is actuated from its retracted position, shown in broken lines in FIG. 1, to an extended position, shown in full lines in FIG. 1.

When the transport shutter 35 has reached its destination position, over the conveyor 36, the transported ply is engaged and held, during the movement of the shutter plate for pick up of a subsequent ply. As the shutter plate moves out from underneath the restrained ply, it drops onto the conveyor 36, whereupon it is conveyed away to a subsequent processing operation, such as a sewing step. Since the ply is progressively released by the returning shutter plate, it is appropriate to momentarily stop the conveyor 36 while it receives the ply, to avoid skewing the ply by reason of the conveyor motion. Alternatively, a suitable receiving platform (not shown) may be extended up in the spaces 130 between the individual belt sections of the conveyor to receive the ply, holding it above the conveyor surface. After the shutter has completely released the ply, the platform may be withdrawn through the spaces 130 to deposit the ply onto the moving conveyor.

As reflected in FIGS. 1 and 2, the equipment includes a pair of retractable sweep arms 78 mounted on a rock shaft 134 journalled in the frame plate 41, 42. The shaft 134 is connected by a lever arm 135 to a sweep arm actuator 77 anchored to the machine frame. When the actuator 77 is energized to its extended condition, the shaft 134 is rotated clockwise and the sweep arms are raised up above the transport plate 35. When the actuator is retracted, the arms are lowered, and downwardly offset extensions 136 of the sweep arms are positioned to overlie in paralled relation the shutter plate 35 and the trailing edge region of the separated ply, when the transport shutter is in its destination position.

The offset extensions 136 of the sweep are provided with downwardly projecting positoning lugs 137, which are somewhat thicker than the thickness of the separated ply 46. When the sweep arm actuator 77 is retracted, these lugs 137 are brought to bear resiliently on the upper surface of the transport plate 35, with a surface sliding relationship, such that the plate may subsequently be actuated to move back to its extended or ply pick up position, with the lugs 137 remaining in contact with the plate and sliding over its upper surface. The forward-facing edges 138 of the lugs 137 form positioning abutments, for engagement with and alignment of the rear ply edge 126, in the manner to be described. In this connection, the respective sweep arms 78 may include provisions for slight longitudinal adjustment, to effect precise alignment of the positioning lugs 137.

After lowering of the sweep arms 78, the transport shutter plate 35 may commence its extending movement to the ply pick up position. As it does so, the ply edge 126 will tend to engage at least one of the vertical abutment surfaces 138.

If the transported ply 46 is slightly rotationally disoriented as the shutter 35 moves to the right, the ply edge 126 will be urged into engagment with one of the positioning lugs, but the frictional forces of the shutter plate moving out from under the disoriented ply are not reliably effective to urge the disoriented ply into contact with the second positioning lug. Provisions are made for effecting a laterally outward sweeping movement of the sweep arms 78 during the extending movement of the shutter 35. The combination of such movements has been found to be highly effective in bringing about the desired reorientation of the ply, so that it is properly aligned with the conveyor 36 as it is deposited thereon.

The present invention, therefore, provides an extremely advantageous means for lowering and lifting a ply picking unit into controlled pressure contact with the top ply of a ply stack. The torque imparted by the actuator rod 44 to the lifting arm assembly 31 may be accurately controlled by the adjusted setting of the spring 85. At the same time, the lifting arm assembly 31 is counter balanced by the torsion spring 86 so that the operating pressure exerted by the arm assembly 31 may be very delicately and precisely controlled by the compression spring 85.

When the balance lifting apparatus of the present invention is used in combination with the ply picking means of the aforementioned Morton patent, the result is an extremely practical and efficient means for picking a limp ply from a stack thereof. The combined apparatus is accurately adjustable to operate on a wide variety of different ply materials and represents a significant improvement in the ply picking art.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. In an apparatus for nipping and lifting a limp ply from a stack thereof, a lifting unit for controllably lowering and lifting a ply picking unit, which comprises a. a frame b. a ply picking unit for nipping and lifting a limp ply from a stack thereof, c. support means for said ply picking unit, comprising a lifting lever pivotally mounted on said frame, d. actuator means pivotally mountd on said frame and operable through a predetermined stroke, e. a spring interconnecting said actuator means and said lifting lever, f. means independent of said actuator means for effectively substantially balancing said lifting lever, and g. adjustable means interconnecting said spring and said actuator means for controlling the amount of displacement of said spring caused by the predetermined stroke of said actuator means whereby the maximum force imparted by said actuator means to be lifting lever will be limited by said adjustable means thereby permitting accurate control of the pressure applied by said ply picking unit to a top ply of a ply stack.

2. The apparatus according to claim 1, further characterized by a. a shaft mounted on said frame, b. said lifting lever being mounted for rotation about the axis of said shaft, c. said ply picking unit being mounted on said lifting lever at the front end thereof, d. said lifting lever being provided with an outwardly extending lever arm, e. said actuator means being slidably connected to said outwardly extending arm by slidable connecting means, and f. said spring acting between said actuator means and said connecting means whereby the maximum force imparted by said actuator will be limited by the compression of said spring.

3. The apparatus according to claim 2, further characterized by a. said balancing means comprising a torsion spring acting on said lifting lever.

4. The apparatus according to claim 3, further characterized by a. said shaft rotatably supporting said lifting lever, and b. said torsion spring acting between said shift and said lifting lever.

5. The apparatus according to claim 2, further characterized by a. said actuator means comprising a fluid actuator, b. said fluid actuator provided with an actuating rod, and said adjustable means comprising a collar element adjustably positioned on said actuating rod, and acting against one end of said spring.

6. The apparatus according to claim 5, further characterized by a. said actuator rod being threaded, and b. said collar element comprising a threaded collar adjustably positioned on said threaded actuating rod.

7. In an apparatus for nipping and lifting a limp ply, a lifting unit for controllaby lowering and lifting a ply picking unit, which comprises a. a frame, b. a ply picking unit for nipping and lifting a limp ply from a stack thereof, c. support means for said ply picking unit, comprising a lifting lever pivotally mounted on said frame, d. actuator means pivotally mounted on said frame and operable through a predetermined stroke, e. slidable connecting means interconnecting said actuator means and said lifting lever, f. means independent of said actuator means for effectively, substantially balancing said lifting lever, and g. adjustable, yieldable means acting between said actuator means and said slidable connecting means for controlling the amount of force imparted by said actuator means to said lift lever whereby the pressure applied by said ply picking unit to a top ply of a ply stack can be accurately controlled.

8. The apparatus according to claim 7, further characterized by a. said actuator means including an actuating rod, b. said slidable connecting mean comprising a connecting element mounted on said lifting lever, and c. said actuating rod being slidably connected to said connecting element.

9. The apparatus according to claim 8, further characterized by a. said actuating rod being threated, b. said adjustable, yieldable means comprising a spring acting between said actuating rod and said connecting element, and c. a threaded collar adjustably positioned on said threaded actuating rod and acting against one end of said spring, whereby the maximum force imparted by said actuating means to said lifting lever will be limited by the compression of said spring.

10. The apparatus according to claim 9, further characterized by a. said spring being coaxial with said actuating rod.

* * * * *